United States Patent [19]

Harada et al.

[11] 4,184,460

[45] Jan. 22, 1980

[54] ELECTRONICALLY-CONTROLLED FUEL INJECTION SYSTEM

[75] Inventors: Susumu Harada, Oobu; Masakazu Ninomiya, Kariya, both of Japan

[73] Assignee: Nippondenso Co., Ltd., Kariya, Japan

[21] Appl. No.: 787,225

[22] Filed: Apr. 13, 1977

[30] Foreign Application Priority Data

| | | | |
|---|---|---|---|
| May 28, 1976 | [JP] | Japan | 51-62554 |
| Jun. 21, 1976 | [JP] | Japan | 51-73458 |
| Jul. 14, 1976 | [JP] | Japan | 51-84254 |
| Aug. 27, 1976 | [JP] | Japan | 51-102827 |

[51] Int. Cl.[2] ..... F02B 3/00; F02B 3/10; F02M 51/00

[52] U.S. Cl. ..... 123/32 EG; 123/117 D; 364/431; 123/32 EA

[58] Field of Search ..... 123/32 EA, 32 AE, 117 D, 123/32 EG; 364/431

[56] References Cited

U.S. PATENT DOCUMENTS

| | | | |
|---|---|---|---|
| 3,646,918 | 3/1972 | Nagy et al. | 123/32 EG |
| 3,734,067 | 5/1973 | Glockler et al. | 123/32 EG |
| 4,073,270 | 2/1978 | Endo | 364/431 |
| 4,091,773 | 5/1978 | Gunda | 123/32 EA |

*Primary Examiner*—Samuel W. Engle
*Assistant Examiner*—Thomas H. Webb
*Attorney, Agent, or Firm*—Cushman, Darby & Cushman

[57] ABSTRACT

An electronically-controlled fuel injection system includes electromagnetic fuel injection valves each of which is mounted in each cylinder of an internal combustion engine, and the injection of fuel during the starting period of the engine is also effected only by these fuel injection valves. During the starting period of the engine, the duration of the opening of the fuel injection valves is controlled at a constant value irrespective of the rotational speed of the engine until the rotational speed reaches a value corresponding to the initial combustion of fuel in the engine, after which the duration of the opening of the fuel injection valves is controlled in relation to the rotational speed of the engine. Further, during the time that the starter motor is in operation, the duration of the opening of the fuel injection valves which was basically determined in the previously mentioned manner is increased to a great extent in accordance with the temperature of the engine until the engine rotational speed reaches a value corresponding to the complete combustion of fuel in the engine.

11 Claims, 7 Drawing Figures

ELECTRONICALLY-CONTROLLED FUEL INJECTION SYSTEM

BACKGROUND OF THE INVENTION

1. Field of the Invention

The present invention relates to an electronically-controlled fuel injection system for internal combustion engine in which the amount of fuel supplied to the engine is controlled by the duration of the opening of electromagnetic fuel injection valves or the duration of fuel injection, and more particularly the invention relates to such an electronically-controlled fuel injection system designed to improve the mode of fuel injection during the starting periods of an internal combustion engine.

2. Description of the Prior Art

A known electronically-controlled fuel injection system of the above type includes, for the purpose of ensuring an improved starting performance during the time that the cooling water temperature of the engine is low, one or a plurality of electromagnetic cold starting injectors which are mounted in the intake manifold remote from and upstream of the engine cylinders in addition to the electromagnetic fuel injection valves mounted in the respective engine cylinders (the main injectors), and a thermo-time switch which maintains the injection time of the cold starting injectors in relation to the time and the temperature and which renders the cold starting injectors inoperative during the continued rotation of the starter motor to prevent misfiring of the spark plugs.

This prior art system is disadvantageous in that the use of cold starting injectors and a thermo-time switch which are complicated in construction and expensive, is required only for engine starting purposes, and moreover the provision of fuel lines to the cold starting injectors and the electrical wiring of the thermo-time switch not only increases the manufacturing cost of the system but also makes the maintenance of the system difficult.

Another disadvantage is that since the system is designed so that during the starting period a very great amount of fuel is injected in the intake manifold of the engine and only a part of the fuel is vaporized and drawn into the cylinders thus starting the engine, after the engine has started some of the fuel still remains in the intake manifold of the engine so that after the completion of the starting the remaining fuel is gradually drawn into the engine, thus increasing harmful exhaust emissions (in particular, the amount of HC in the exhaust gases).

SUMMARY OF THE INVENTION

It is an object of this invention to provide an electronically-controlled fuel injection system which is capable of accomplishing the starting of an internal combustion engine without any cold starting injectors.

It is another object of this invention to provide an electronically-controlled fuel injection system in which the amount of fuel to be injected is increased greatly in accordance with the temperature of an internal combustion engine during the time that the starter motor is in operation and the engine rotational speed is below that rotational speed at which complete combustion of fuel takes place in the engine.

It is still another object of this invention to provide an electronically-controlled fuel injection system in which considerable starting enrichment of the fuel in accordance with the engine temperature, is controlled in accordance with the operating time of a starter motor.

It is still another object of the invention to provide an electronically-controlled fuel injection system in which the injection of the considerably enriched starting fuel is cut off when operating time of a starter motor becomes too long.

DESCRIPTION OF THE PREFERRED EMBODIMENTS

Figure 1:
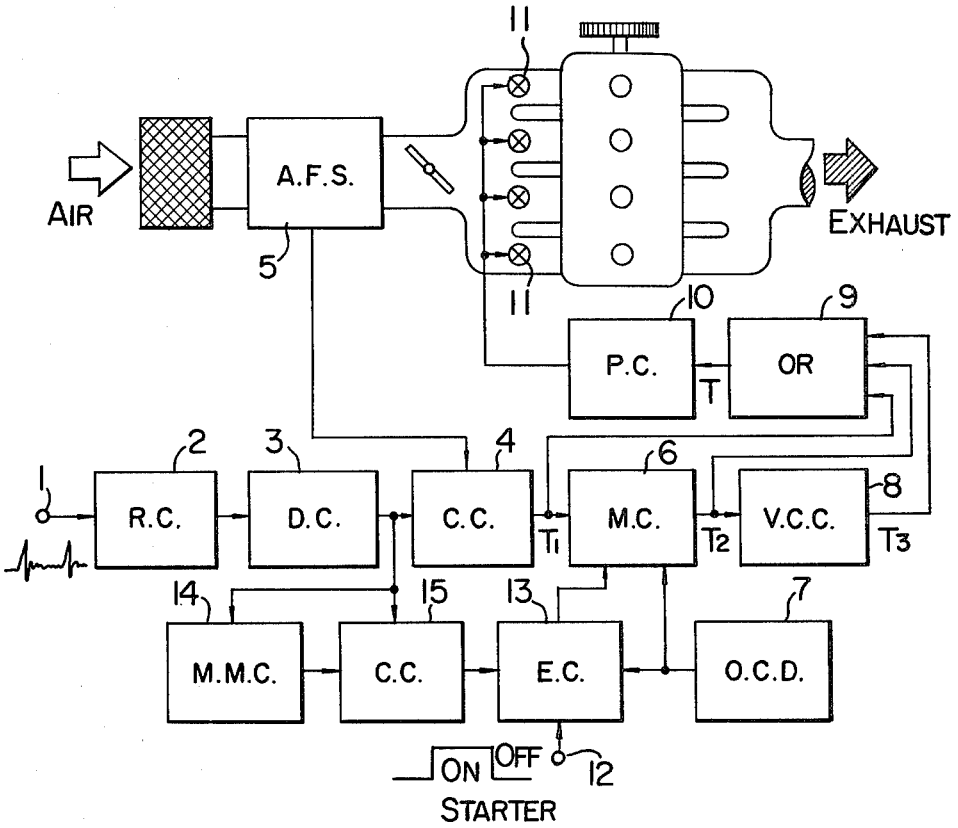
FIG. 1 is a block diagram showing the entire construction of a first embodiment of the invention.

The present invention will now be described in reference to the preferred embodiments shown in the accompanying drawings wherein like reference numerals refer to like parts. Referring first to FIG. 1 showing the first embodiment of the invention, reference numeral 1 designates the primary terminal of an ignition coil for generating an engine speed signal consisting of a pulse signal, 2 a reshaper circuit (R.C.) for reshaping the waveform of the pulse signal, 3 a divider circuit (D.C.) which comprises, in the case of a four cylinder engine, a $\frac{1}{2}$ frequency divider circuit to actuate main injectors or electromagnetic fuel injection valves 11 once for every revolution of the engine for injecting fuel. Numeral 4 designates a computer circuit (C.C.) adapted to receive the speed signal from the divider circuit 3 and the signal from an air flow sensor (A.F.S.) 5 which is indicative of the amount of intake air whereby the engine intake air amount is divided by the engine rotational speed to generate a pulse signal $T_1$ having a time width $t_p$. The time width $t_p$ is proportional to the amount of air drawn into each cylinder for every stroke. Numeral 6 designates a multiplier circuit (M.C.) wherein the pulse time width $t_p$ of the pulse signal $T_1$ produced from the computer circuit 4 is multiplied by the output signal of an operating condition detector (O.C.D.) 7 which detects the engine cooling water temperature, intake air temperature or the like to generate a pulse signal $T_2$ of a pulse time width $t_m$. Numeral 8 designates a voltage compensation circuit (V.C.C.) which receives the pulse signal $T_2$ from the multiplier circuit 6 to provide compensation for changes in the fuel injection quantity of the electromagnetic fuel injection valves 11 due to the power supply voltage changes and generates a pulse signal $T_3$ having a pulse time width $t_u$ corresponding to the power supply voltage. Numeral 9 designates an OR circuit (OR) for receiving the pulse signals $T_1$, $T_2$ and $T_3$ from the computer circuit 4, the multiplier circuit 6 and the voltage compensation circuit 8 to supply to a power circuit (P.C.) 10 a pulse signal T of a pulse time width ($t_p+t_m+t_u$). Numeral 12 designates a terminal for detecting the operating condition of a starter motor which is not shown, whereby the application of a starter signal to the terminal 12 actuates an enrichment circuit (E.C.) 13 which determines the rate of fuel enrichment in accordance with the signal from the operating condition detector 7 which is indicative of the engine cooling water temperature. Connected to the divider circuit 3 are a monostable multivibrator circuit (M.M.C.) 14 and a comparison circuit (C.C.) 15, and the comparison circuit 15 controls the operation of the enrichment circuit 13 in accordance with the result of a comparison between the pulse signal applied from the divider circuit 3 and having a time width inversely proportional to the engine rotational speed and the pulse signal applied from the monostable multivibrator circuit 14 in synchronism with the pulse signal from the divider circuit 3 and having a constant time width. In other words, the comparison circuit 15 controls the application of the output signal of the enrichment circuit 13 to the multiplier circuit 6 only when the engine rotational speed is higher than a predetermined rotational speed (e.g., 400 rpm) which corresponds to the complete combustion of fuel in the engine. The power circuit 10 is designed to open the electromagnetic fuel injection valves 11 mounted in the respective engine cylinders for the duration ($t_p+t_m+t_u$) of the pulse signal T and thereby supply the optimum amount of fuel to the engine to suit the operating conditions thereof.

The computer circuit 4 comprises for example a variable pulse time width multivibrator of the type disclosed in U.S. Pat. No. 3,750,631. Thus, the charging of the capacitor is controlled by the pulse signal from the divider circuit 3, and the discharging of the capacitor is controlled by the air flow sensor 5. This results in the production of a pulse signal $T_1$ of a time width $t_p$ which is inversely proportional to the engine rotational speed and proportional to the amount of the air drawn into the engine. Since the time width of the pulse signal from the divider circuit 3 is inversely proportional to the rotational speed of the engine, as disclosed in the above-mentioned patent and known in the art, the circuit constants of the computer circuit 4 may be suitably selected so that the voltage across the capacitor is saturated at low rotational speeds, and consequently the pulse width $t_p$ is held constant with the engine rotational speed when the speed is lower than a predetermined value (e.g., 125 rpm) which corresponds to the initial combustion of the fuel in the engine. Thus, the time width $t_p$ of the pulse signal $T_1$ generated from the computer circuit 4 is maintained constant with the rotational speeds lower than the first predetermined rotational speed (125 rpm), and the pulse time width $t_p$ is inversely proportional to the rotational speeds higher than the first predetermined rotational speed.

Figure 2:
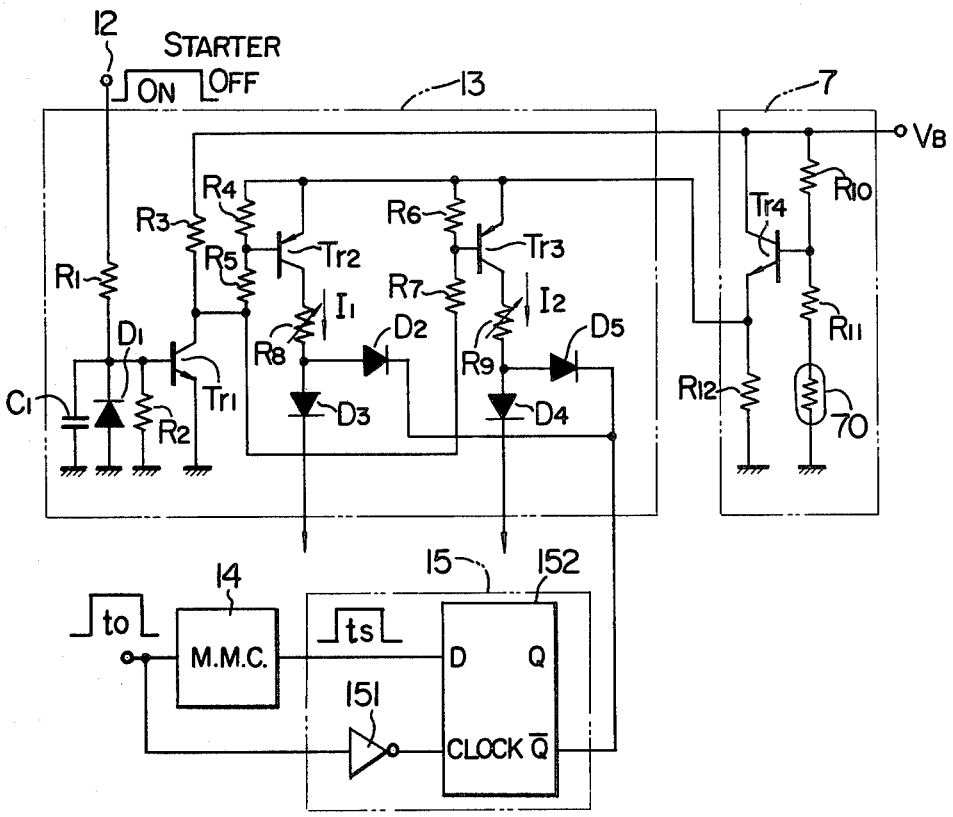
FIG. 2 is a wiring diagram showing a detailed construction of the principal parts of the embodiment shown in FIG. 1.

FIG. 2 shows a detailed construction of the operating condition detector 7, the enrichment circuit 13 and the comparison circuit 15. As shown in the Figure, the enrichment circuit 13 comprises a capacitor $C_1$, diodes $D_1$ to $D_5$, resistors $R_1$ to $R_9$ and transistors Tr1, Tr2 and Tr3, the comparison circuit 15 comprises an inverter 151 and a D-type flip-flop 152, and the operating condition detector 7 comprises a water temperature detecting thermistor 70, resistors $R_{10}$ to $R_{12}$ and a transistor Tr4. In the operating condition detector 7, the resistance value of the thermistor 70 increases with decrease in the cooling water temperature of the engine, and consequently the emitter potential of the transistor Tr4 connected in emitter follower configuration with the resistor $R_{12}$ increases with decrease in the cooling water temperature. On the other hand, the enrichment circuit 13 is designed so that when the starter motor which is not shown is in operation, a starter signal of high level voltage is applied to the terminal 12 thus turning the transistor Tr1 on. When the transistor Tr1 is turned on, the transistors Tr2 and Tr3 are both turned on, and consequently currents $I_1$ and $I_2$ respectively flow through the transistors Tr2 and Tr3. In this case, since the voltage across the resistor $R_{12}$ of the operating condition detector 7 is applied to the emitter of the transistors Tr2 and Tr3, respectively in place of a constant supply voltage $V_B$, the currents $I_1$ and $I_2$ increase with increase in the emitter potential of the transistor Tr4. Namely, the currents $I_1$ and $I_2$ increase as the cooling water temperature decreases. The operation of the enrichment circuit 13 is controlled by the comparison circuit 15. The monostable multivibrator circuit 14 receives from the divider circuit 3 a pulse signal having a time width $t_o$ which is inversely proportional to the engine rotational speed, so that each time a pulse signal is applied from the divider circuit 3, the monostable multivibrator circuit 14 generates a pulse signal of a constant time width $t_s$. This time width $t_s$ is predetermined to correspond to a second predetermined value (400 rpm) of the engine rotational speed, and the pulse signal of the time width $t_s$ is applied to the data terminal D of the D-type flip-flop 152. On the other hand, the pulse signal from the divider circuit 3 is inverted by the inverter 152 and then applied to the clock terminal CLOCK of the D-type flip-flop 152. Thus, when the engine rotational speed is lower than the second predetermined rotational speed, the pulse time width $t_o$ becomes greater than the pulse time width $t_s$ so that the D-type flip-flop 152 produces a high level voltage at its output terminal $\overline{Q}$. On the contrary, when the engine rotational speed is higher than the second predetermined rotational speed, the pulse time width $t_o$ becomes smaller than the pulse time width $t_s$ so that the D-type flip-flop 152 generates a low level voltage at its output terminal $\overline{Q}$. Thus, only when the comparison circuit 15 generates a high level voltage, the currents $I_1$ and $I_2$ flowing to the transistors Tr2 and Tr3 of the enrichment circuit 13 respectively flow into the multiplier circuit 6 through the diodes $D_3$ and $D_4$, whereas when the comparison circuit 15 generates a low level voltage, the currents $I_1$ and $I_2$ flow into the comparison circuit 15 through the diodes $D_2$ and $D_5$ and thus the currents $I_1$ and $I_2$ do not practically flow into the multiplier circuit 6. In other words, the currents $I_1$ and $I_2$ of large magnitude flow from the enrichment circuit 13 into the multiplier circuit 6 only when the engine rotational speed is lower than the second predetermined rotational speed (400 rpm). On the other hand, when the starter motor is not in operation, the transistors Tr1, Tr2 and Tr3 of the enrichment circuit 13 are turned off altogether, thus cutting off the currents $I_1$ and $I_2$.

The multiplier circuit 6 into which the currents $I_1$ and $I_2$ flow, comprises a variable time width multivibrator as in the case of the computer circuit 4. This multivibrator includes a capacitor which is charged for the duration of the time width $t_p$ of the pulse signal $T_1$ from the computer circuit 4, and it generates a pulse signal $T_2$ having a pulse time width $t_m$ equal to the duration of the discharge time after the completion of the charging of the capacitor. The multivibrator is designed so that the pulse time width $t_m$ increases with increase in the current supplied from the external circuit during the charge, and the pulse time width $t_m$ increases with increase in the current supplied from the external circuit during the discharging. As a result, if the charging and discharging of the capacitor in the multiplier circuit 6 are respectively controlled by the currents $I_1$ and $I_2$ from the enrichment circuit 13 shown in FIG. 2, the pulse time width $t_m$ of the pulse signal $T_2$ generated from the multiplier circuit 6 increases with increase in the magnitude of the currents $I_1$ and $I_2$. As mentioned previously, the currents $I_1$ and $I_2$ that flow from the enrichment circuit 13 into the multiplier circuit 6 increase with decrease in the cooling water temperature of the engine while the starter is in operation, while the currents $I_1$ and $I_2$ are practically cut off when the starter motor is not in operation and also when the engine rotational speed is higher than the second predetermined rotational speed. Consequently, the time width $t_m$ of the pulse signal $T_2$ is increased greatly only when the starter motor is in operation and the engine rotational speed is lower than the second predetermined rotational speed.

Figure 3:
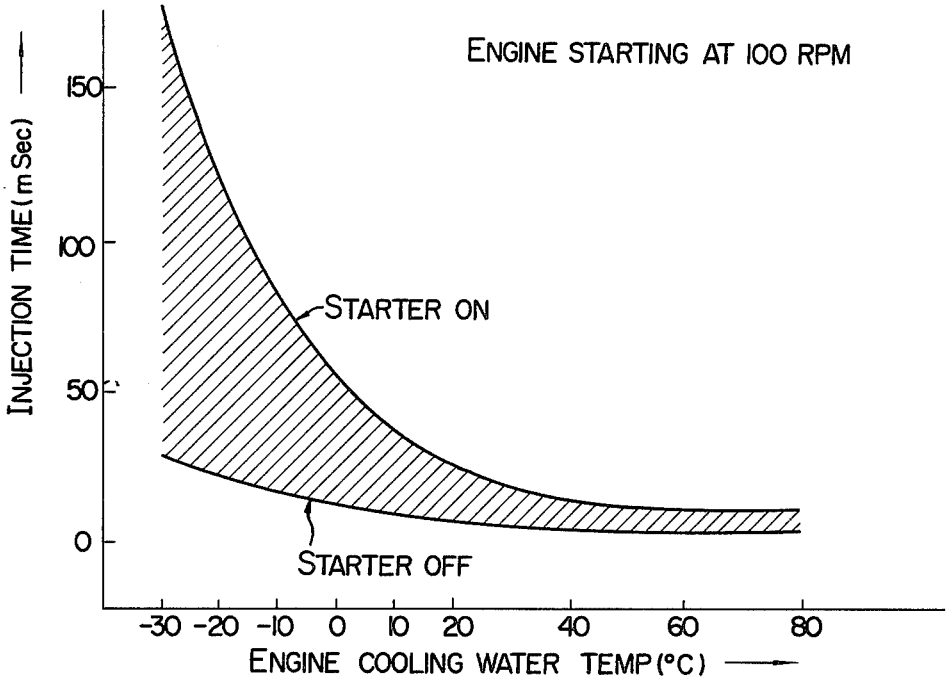
FIGS. 3 and 4 are fuel injection characteristic diagrams which are useful in explaining the operation of the first embodiment.
Figure 4:
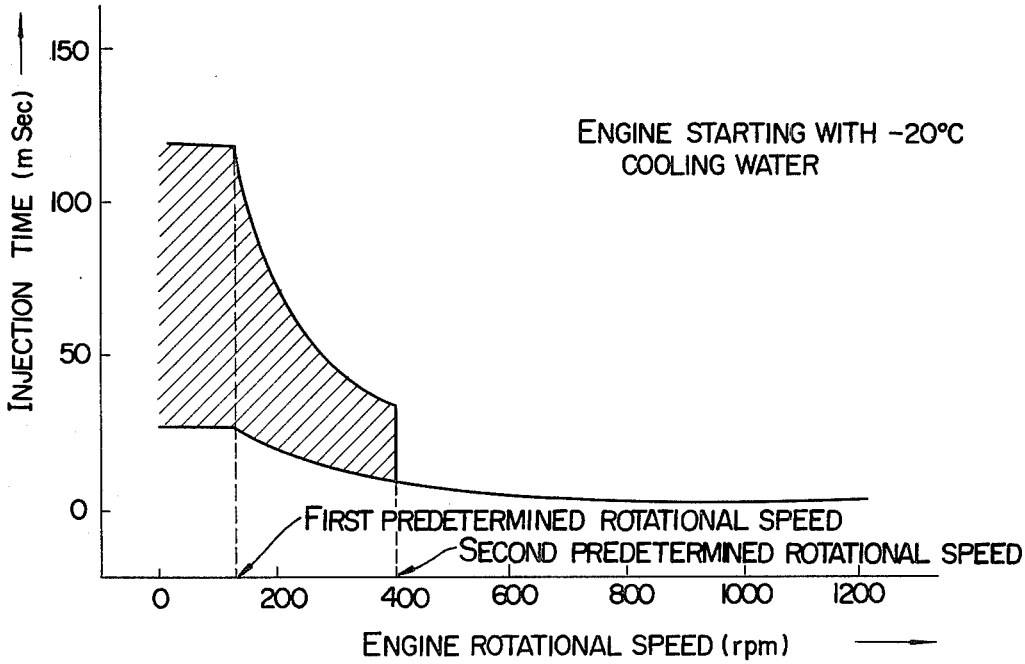

The pulse signal $T_1$ generated from the computer circuit 4, the pulse signal $T_2$ generated from the multiplier circuit 6 and the pulse signal $T_3$ generated from the voltage compensation circuit 8 are all applied to the OR circuit 9 which in turn forms the sum of the input pulse time widths. FIGS. 3 and 4 show the time width characteristics of the pulse signal T from the OR circuit 9. FIG. 3 shows the relationship between the cooling water temperature and the fuel injection time at the engine rotational speed of 100 rpm, and the fuel injection time increases with decrease in the cooling water temperature, particularly when the starter motor is in operation the fuel injection time increases greatly at low engine cooling water temperature by the hatched amounts as compared with those obtained when the starter motor is not in operation. FIG. 4 shows the relationship between the engine rotational speed and the fuel injection time at the engine cooling water temperature of −20° C., namely, the fuel injection time is held constant when the engine rotational speed is below the first predetermined rotational speed, the fuel injection time descreases in inverse proportion to the engine rotational speed which is above the first predetermined rotational speed. In FIG. 4, the lowermost characteristic curve represents the fuel injection time with no temperature dependent fuel enrichment and the hatched region indicates the amount of fuel enrichment provided in dependence on the temperature. The first and second predetermined rotational speeds are respectively set to correspond, as mentioned previously, to the initial combustion of fuel and the complete combustion of fuel during the starting period which is followed by the idling (e.g., 800 rpm) period of the engine, so that transition from the initial combustion to the complete combustion is accomplished smoothly, and there is no danger of causing misfiring of the spark plugs or the like due to excessive supply of fuel even if the starter motor is continuously operated after the complete combustion has taken place.

Figure 5:
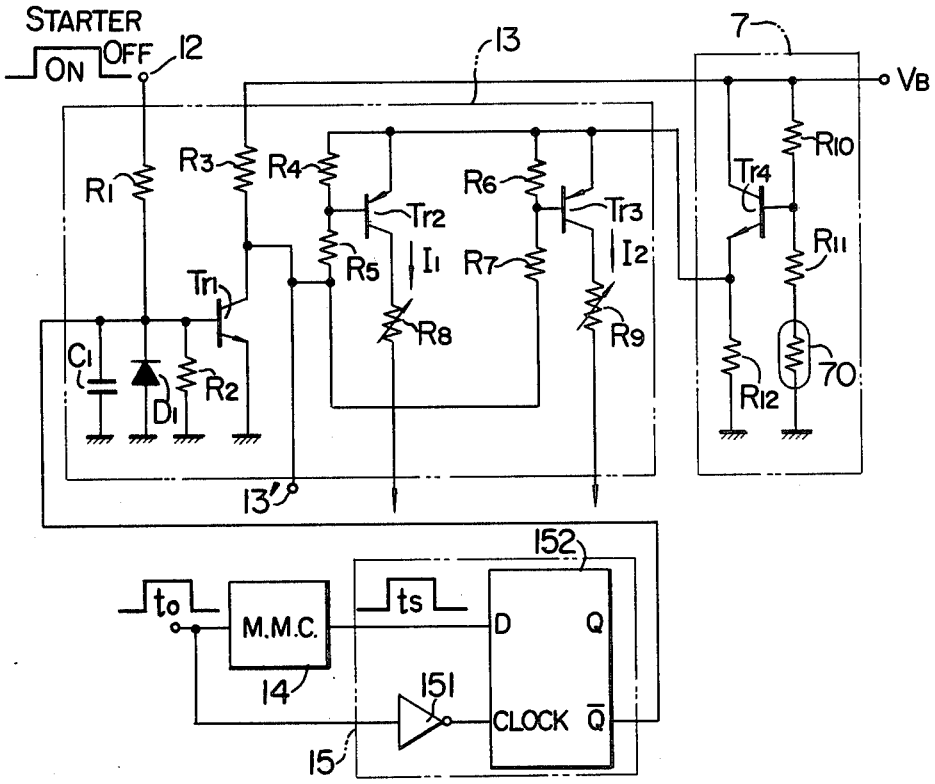
FIG. 5 is a wiring diagram showing a modification of the circuit construction of the first embodiment shown in FIG. 2.

A modification of the circuit construction of FIG. 2 is shown in FIG. 5. In the circuit construction of FIG. 5, the output signal of the comparison circuit 15 is applied to the base of the transistor Tr1 of the enrichment circuit 13 in addition to the starter signal. With this construction, when the engine rotational speed exceeds the second predetermined rotational speed (400 rpm), irrespective of the presence or absence of the starter signal, the transistor Tr1 is turned off and the flow of the currents $I_1$ and $I_2$ is cut off. Thus, as in the case of the embodiment shown in FIG. 2, when the starter motor is in operation and the engine rotational speed is below the second predetermined rotational speed, the fuel is enriched considerably in accordance with the cooling water temperature as shown in FIGS. 3 and 4. In FIG. 5, a terminal 13' is adapted for connection to the computer circuit 4, and the terminal 13' may be connected to the computer circuit 4 when it is desired to increase the time width $t_p$ of the pulse signal $T_1$ generated from the computer circuit 4 over that value proportional to the actual amount of air drawn into the engine.

Figure 6:
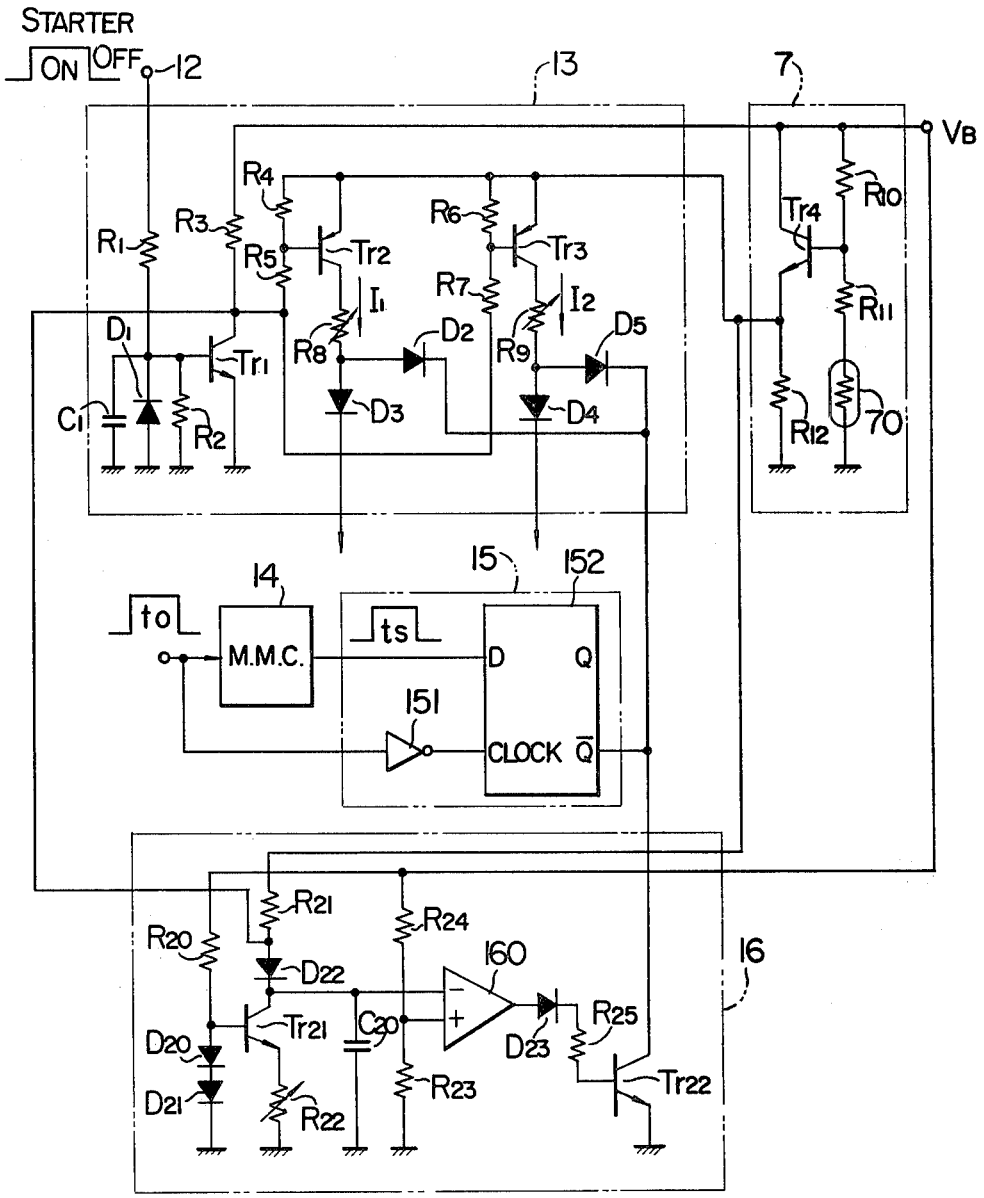
FIG. 6 is a wiring diagram showing a detailed construction of the principal parts of a second embodiment of the invention.

The second embodiment shown in FIG. 6 is an improvement of the first embodiment of FIG. 2. The second embodiment differs from the first embodiment in that a timer circuit 16 is further provided, whereby when the operating time of the starter motor increases, the considerable enrichment of fuel in accordance with the engine temperature is stopped. The timer circuit 16 comprises a comparator 160, resistors $R_{20}$ to $R_{25}$, diodes $D_{20}$ to $D_{23}$, transistors Tr21 and Tr22 and a capacitor $C_{20}$. The emitter of the transistor Tr4 in the operating condition detector 7 is further connected to the capacitor $C_{20}$ of the timer circuit 16 by way of the resistor $R_{21}$ and the diode $D_{22}$. The collector of the transistor Tr1 in the enrichment circuit 13 is further connected to the junction point of the resistor $R_{21}$ and the diode $D_{22}$ in the timer circuit 16. Consequently, when there is no starter signal applied to the terminal 12, the capacitor $C_{20}$ is charged in proportion to the output voltage of the operating condition detector 7, and the comparator 160 generates a low level voltage, thus turning the transistor Tr22 off. When, in this condition, the starter motor is turned on so that a starter signal is applied to the terminal 12, the transistors Tr1 to Tr3 of the enrichment circuit 13 are turned on, and considerable enrichment of fuel by the currents $I_1$ and $I_2$ is accomplished. When the transistor Tr1 is turned on, a low level voltage is applied to the junction point of the resistor $R_{21}$ and the diode $D_{22}$, and the capacitor $C_{20}$ is no longer charged but starts discharging. This discharging takes place through the transistor Tr21 and the resistor $R_{22}$ and continues as long as the starter is in operation. When the operating time of the starter or the discharge time of the capacitor $C_{20}$ increases, the voltage developed across the capacitor $C_{20}$ becomes lower than a preset value determined by the resistors $R_{23}$ and $R_{24}$, and the comparator 160 generates a high level voltage, thus turning the transistor Tr22 on. Since the collector of the transistor Tr22 is connected to the cathode of the diodes $D_2$ and $D_5$ in the enrichment circuit 13, when the operating time of the starter exceeds a predetermined time, the currents $I_1$ and $I_2$ flow into the timer circuit 16 thus stopping the considerable enrichment of the fuel. This predetermined time is increased with decrease in the cooling water temperature, since the capacitor $C_{20}$ is charged to the output voltage of the operating condition detector 7 as mentioned previously. This predetermined time may be maintained at a constant value which is independent of the cooling water temperature, and this may be accomplished simply by connecting one end of the resistor $R_{21}$ to the constant voltage source $V_B$. With this second embodiment, the considerable enrichment of fuel during the engine starting period is stopped when the operating time of the starter exceeds the predetermined time, after which the fuel injection time is controlled at the values obtained with the starter off as shown in FIG. 3 and the values indicated by the lowermost characteristic curve in FIG. 4. Consequently, if, for example, the battery voltage drops thus decreasing the spark energy of the spark plugs and the starter motor is operated continuously for the purpose of starting the engine, the considerable enrichment of the fuel for engine starting purposes is stopped, thus preventing the spark plugs from being completely disabled to ignite due to excessively enriched fuel.

Figure 7:
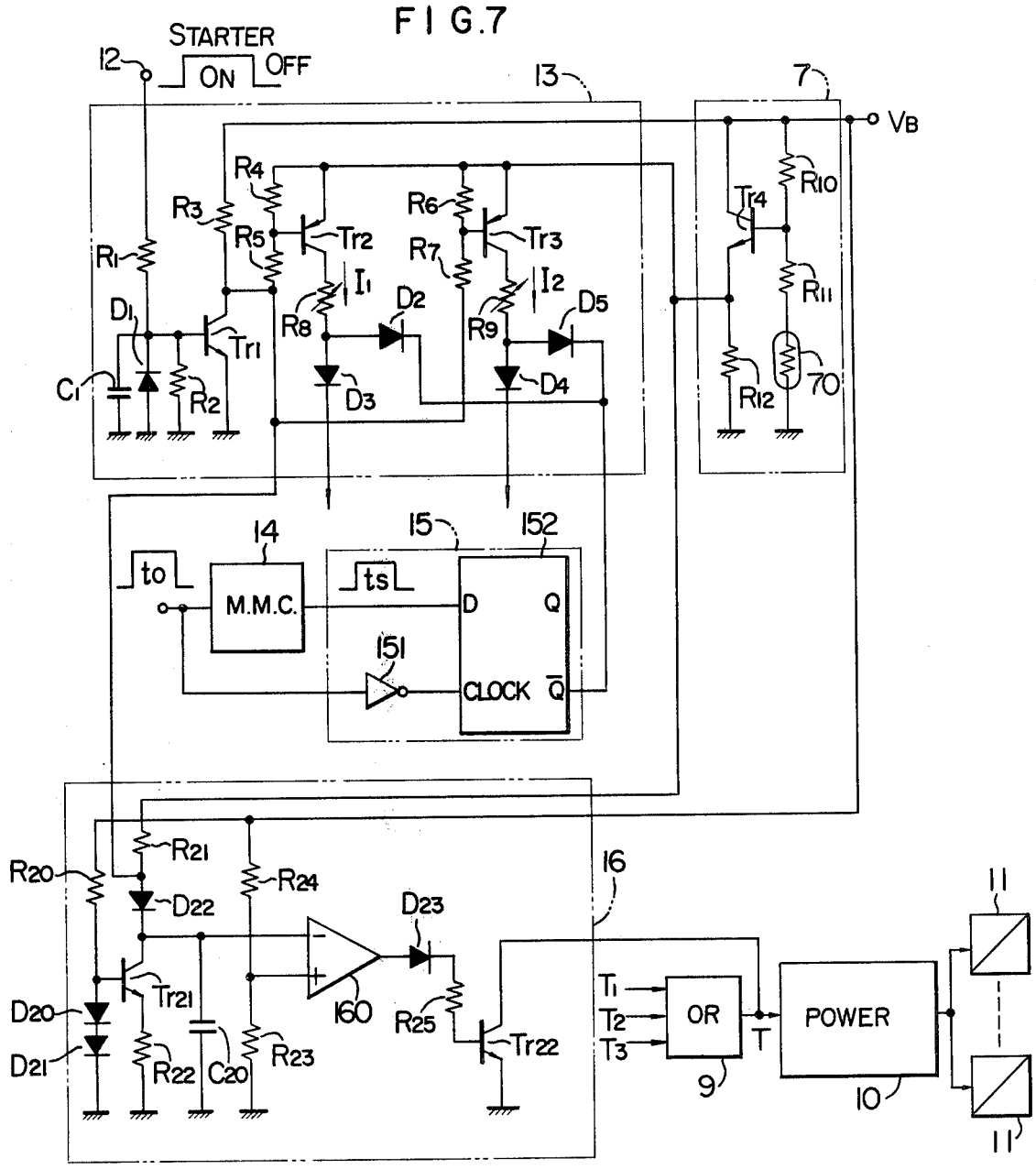
FIG. 7 is a wiring diagram showing a detailed construction of the principal parts of a third embodiment of the invention.

The third embodiment shown in FIG. 7 is an improvement of the second embodiment. The third embodiment differs from the second embodiment only in that the output terminal of the timer circuit 16 is connected to the junction point of the OR circuit 9 and the power circuit 10. With this third embodiment, when the operating time of the starter motor exceeds a preset time, the pulse signal T generated from the OR circuit 9 is cut off by the transistor Tr22 and is not supplied to the power circuit 10. By virtue of this operation, when the starter motor is operated continuously after failure to start the engine, the injection of fuel from the electromagnetic fuel injection valves 11 is completely stopped, thus preventing loss of fuel and misfiring of the spark plugs and facilitating restarting operation of the engine.

What is claimed is:

1. An electronically-controlled fuel injection system for internal combustion engines comprising:

fuel injection means for injecting fuel in each cylinder of an engine during the opening thereof;

trigger means for generating a trigger signal synchronized with the rotation of said engine;

computer means for generating a first pulse signal in response to said trigger signal, said first pulse signal having a time width which is constant while the rotational speed of said engine is lower than a first rotational speed preset to correspond to the initial combustion of said fuel and is decreased as the rotational speed of said engine increases while the rotational speed of said engine is higher than said first rotational speed;

speed detection means for generating a detection signal while the rotational speed of said engine is lower than a second rotational speed higher than said first rotational speed at which second rotational speed the complete combustion of said fuel is ensured;

temperature detection means for generating a temperature signal corresponding to the temperature of said engine;

enrichment means adapted to be responsive to the operation of a starter motor for generating an enrichment signal varying in accordance with said temperature signal while said starter motor is operated, said enrichment means being disabled unless said detection signal is applied thereto;

multiplier means for generating a second pulse signal having a time width which is increased as the time width of said first pulse signal increases and is greatly increased as the temperature of said engine falls; and control means for opening said fuel injection means during a time width resulting from the sum of the time widths of said first and second pulse signals.

2. A system as claimed in claim 1 further comprising;

timer means adapted to be responsive to the operation of said starter motor for cutting off said enrichment signal when the operating duration of said starter motor exceeds a predetermined duration, whereby increasing the time width of said second pulse signal greatly depending upon the temperature of said engine is limited to said predetermined duration.

3. A system as claimed in claim 2, wherein said timer means includes:

temperature responsive means adapted to be responsive to said temperature signal for increasing said predetermined duration as the temperature of said engine falls.

4. A system as claimed in claim 1 further comprising:

timer means adapted to be responsive to the operation of said starter motor for stopping the opening of said fuel injection means irrespectively of said first and second pulse signals when the operating duration of said starter motor exceeds a predetermined duration.

5. A system as claimed in claim 4, wherein said timer means includes:

temperature responsive means adapted to be responsive to said temperature signal for increasing said predetermined duration as the temperature of said engine falls.

6. An electronically-controlled fuel injection system for internal combustion engines comprising:

an electromagnetic fuel injector, positioned in the intake side of an engine, for injecting fuel into the cylinder of said engine during the opening thereof;

an air flow sensor, positioned upstream of said fuel injector, for detecting the amount of air sucked into said engine;

a rotational pulse generator, adapted to be responsive to the rotation of said engine, for generating a rotational pulse having a time width inversely proportional to the rotational speed of said engine;

a computer circuit, connected to said air flow sensor and said rotational pulse generator, for generating a reference pulse having a time width which is constant below a first rotational speed preset to correspond to the beginning of fuel combustion in said engine and is varying in direct and inverse proportion to said respective amount of air and rotational speed over said first rotational speed;

a comparator circuit, connected to said rotational pulse generator, for comparing the time width of said rotational pulse with a reference time width indicative of a second rotational speed higher than said first rotational speed at which second rotational speed the complete combustion of fuel in said engine is ensured, to thereby generate a comparison signal only while the rotational speed of said engine is lower than said second rotational speed;

an operating condition detector, adapted to be responsive to the temperature of said engine, for generating a temperature signal indicative of the temperature of said engine;

an enrichment circuit, connected to said comparator circuit and said operating condition detector and adapted to receive a starter signal indicative of the operation of a starter motor, for generating an enrichment signal corresponding to said temperature signal while said starter signal is generated, said enrichment circuit being disabled unless said comparison signal is generated; and a correction circuit, connected to said computer circuit and said enrichment circuit, for widening said reference pulse in response to said enrichment signal to thereby generate an injection pulse which opens said fuel injector, the ratio of widening said reference pulse being increased as the temperature of said engine falls.

7. A system as claimed in claim 6 further comprising:

a timer circuit, adapted to monitor the duration of starter signal generation, for cutting off said enrichment signal when said starter motor is operated longer than a predetermined duration.

8. A system as claimed in claim 6 further comprising:

a timer circuit, adapted to monitor the duration of starter signal generation, for cutting off said injection pulse when said starter motor is operated longer than a predetermined duration.

9. A system as claimed in claim 1, wherein said speed detection means includes:

monostable multivibrator means connected to said trigger means and responsive to said trigger signal, for generating a pulse signal having a time width corresponding to said second rotational speed; and flip-flop means having a data input terminal connected to said monostable multivibrator means, a clock input terminal connected to said trigger means and an output terminal for generating said detection signal.

10. A system as claimed in claim 6, wherein said comparator circuit includes:

monostable multivibrator means connected to said rotational pulse generator and responsive to said rotational pulse, for generating a pulse signal having a time width corresponding to said second rotational speed; and flip-flop means having a data input terminal connected to said monostable multivibrator means, a clock input terminal connected to said rotational pulse generator and an output terminal for generating said comparison signal.

11. In a fuel supply control system for an internal combustion engine having an electromagnetically operated valve which is opened to meter fuel in response to an electric pulse signal having a time width calculated in accordance with engine operating conditions, the improvement comprising:

means for detecting a temperature of said internal combustion engine;

means for detecting a rotational speed of said internal combustion engine;

means for detecting an operation of a starter motor which, when energized, cranks said internal combustion engine;

means for discriminating whether said rotational speed detected by speed detecting means is above or below a predetermined rotational speed above which a complete combustion of fuel is supposed to occur in said internal combustion engine;

means for increasing said time width of said electric pulse signal in accordance with said temperature detected by said temperature detecting means;

means for enabling a time width increasing operation of said time width increasing means upon receipt of both a first output of said starter operation detecting means and a first output of said discriminating means, the former first output indicating that said starter motor is energized and the latter first output indicating that said rotational speed is below said predetermined rotational speed; and means for disabling said time width increasing operation of said time width increasing means upon receipt of either a second output of said starter operation detecting means or a second output of said discriminating means, the former second output indicating that said starter motor is deenergized and the latter second output indicating that said rotational speed is above said predetermined rotational speed.

* * * * *